US006502484B2

(12) United States Patent
Pao-Hsi

(10) Patent No.: US 6,502,484 B2
(45) Date of Patent: Jan. 7, 2003

(54) SCREWDRIVER WITH EASILY REPLACEABLE BITS

(76) Inventor: Lee Pao-Hsi, No. 30,Alley 1, Lane 135, Tsad Fu Road., Wu Feng Hsiang, Taichung (TW)

( * ) Notice: Subject to any disclaimer, the term of this patent is extended or adjusted under 35 U.S.C. 154(b) by 14 days.

(21) Appl. No.: 09/767,798

(22) Filed: Jan. 22, 2001

(65) Prior Publication Data

US 2002/0096024 A1 Jul. 25, 2002

(51) Int. Cl.[7] ..... B25B 23/00
(52) U.S. Cl. ..... 81/439; 81/490
(58) Field of Search ..... 81/177.4, 490, 81/438, 439

(56) References Cited

U.S. PATENT DOCUMENTS 2,629,413 A * 2/1953 Stettler ..... 81/490
5,325,745 A * 7/1994 Koehler ..... 81/439
5,337,637 A * 8/1994 Bih-Lien ..... 81/439
6,134,995 A * 10/2000 Shiao ..... 81/439

* cited by examiner

*Primary Examiner*—Eileen P. Morgan
*Assistant Examiner*—Joni B. Danganan
(74) *Attorney, Agent, or Firm*—W. Wayne Liauh

(57) ABSTRACT

A screwdriver with easily replaceable bits. It contains a body, a sliding element, a controlling element, a handle, and a rotatable bit case. The body includes a storage portion and a straight tube portion. The sliding element is disposed in the straight tube portion and a hook extends from the sliding element. A pair of protrusions are laterally extending from a bottom end of the sliding element. The controlling element is disposed on the straight tube portion. The rotatable bit case has a plurality of longitudinal slots for inserting the bits. Each bit has a circular recess. By simply rotating the bit case, the user can select a desired bit. Furthermore, it can be automatically pushed up or pulled back, to thus significantly increase the ease of use and the utility of the tool.

7 Claims, 9 Drawing Sheets

SCREWDRIVER WITH EASILY REPLACEABLE BITS

BACKGROUND OF INVENTION

1. Field of the Invention

The present invention is related to a screwdriver with easily replaceable bits. With the improved screwdriver of the present invention, the screw bit can be pushed out or pulled back automatically. Furthermore, the novel screwdriver of the present invention improves to ease of use and the utility of the screwdriver significantly.

2. Description of the Prior Art

Hand tools are widely used by people ranging from a professional technician to ordinary household members. Almost every family has a simple tool set. Nowadays, the DIY (do-it-yourself) products are quite popular. For most people, it is necessary to assemble the tool set at home. Regarding the tool design, the development of the tool is is also changing very rapidly. For example, the traditional screwdriver is integrally formed with a specific bit head (which can be either flat head type or cross head type) with a fixed size.

Because the types and sizes of the screwdrivers are different from each other, the user usually needs to buy many screwdrivers with different sizes and types. Thus, it is quite inconvenient to store or to carry these screwdrivers. In addition, the total cost is high. Therefore, a screwdriver with replaceable bit was invented which is shown in FIG. 1. This replaceable screwdriver comprises a handle 1 and a bit rod 2. One end of the bit rod 2 has a bit recess 3 for inserting one of the bits 4 with different sizes and types. The handle 1 is hollow and is covered by a cap 5. This cap 5 is disposed with several slots 6 for storing these bits 4. The user can take off the cap 5 and then pick up a desired bit 4. Thereafter, the user can put the bit 4 into the bit socket 3 to use this screwdriver.

However, such a replacement procedure is quite inconvenient. When the user wants to replace another bit, this user has to take out the original bit 4 from the bit socket 3 again. Next, this user has to open and take out the cap 5 to pick out another bit 4. Then, put the new bit 4 on. If a work needs to use several types and sizes of screwdriver bits, the user has to replace the bits very often. Such repeated replace procedures are extremely inconvenient and time-consuming.

SUMMARY OF THE INVENTION

The primary object of the present invention is to provide a screwdriver with easily replaceable bits. By rotating the bit case, the user can easily select a desired bit so as to achieve the purpose of ease of use.

A next object of the present invention is to provide a screwdriver with easily replaceable bits, such that the bit can be automatically pushed up or pulled back, so as to improve the utility of the screwdriver.

Another object of the present invention is to provide a screwdriver with easily replaceable bits which, by means of the design of steel ball engagement, the sliding element will be positioned precisely.

An additional object of the present invention is to provide a screwdriver with easily replaceable bits which, by means of the hook that engages with the circular recess of the bit, the protruded bit of the present invention will not accidentally fall or drop down by an externally force.

The present invention provides a screwdriver with easily replaceable bits comprising:

a body including a storage portion and a straight tube portion, a bit hole being disposed on a top end of said body, said storage portion having an opening on one side of the body, a pair of straight slots being disposed in said straight tube portion;

a sliding element being disposed in said straight tube portion of the body, a hook extending from a top end of said sliding element and protruding into said storage portion, a pair of protrusions being laterally extending from a bottom end of said sliding element;

a controlling element being disposed on said straight tube portion of said body, a plurality of guiding slots being disposed on an inner surface of the controlling element for guiding said protrusions;

a handle secured on a bottom of said straight tube portion of said body; and a rotatable bit case having several longitudinal. slots for inserting bits, each bit having a circular recess, said bit case being pivoted in said storage portion so that the hook of said sliding element can engage with the circular recess of said bit.

DETAILED DESCRIPTION OF THE PREFERRED EMBODIMENT

Figure 1:
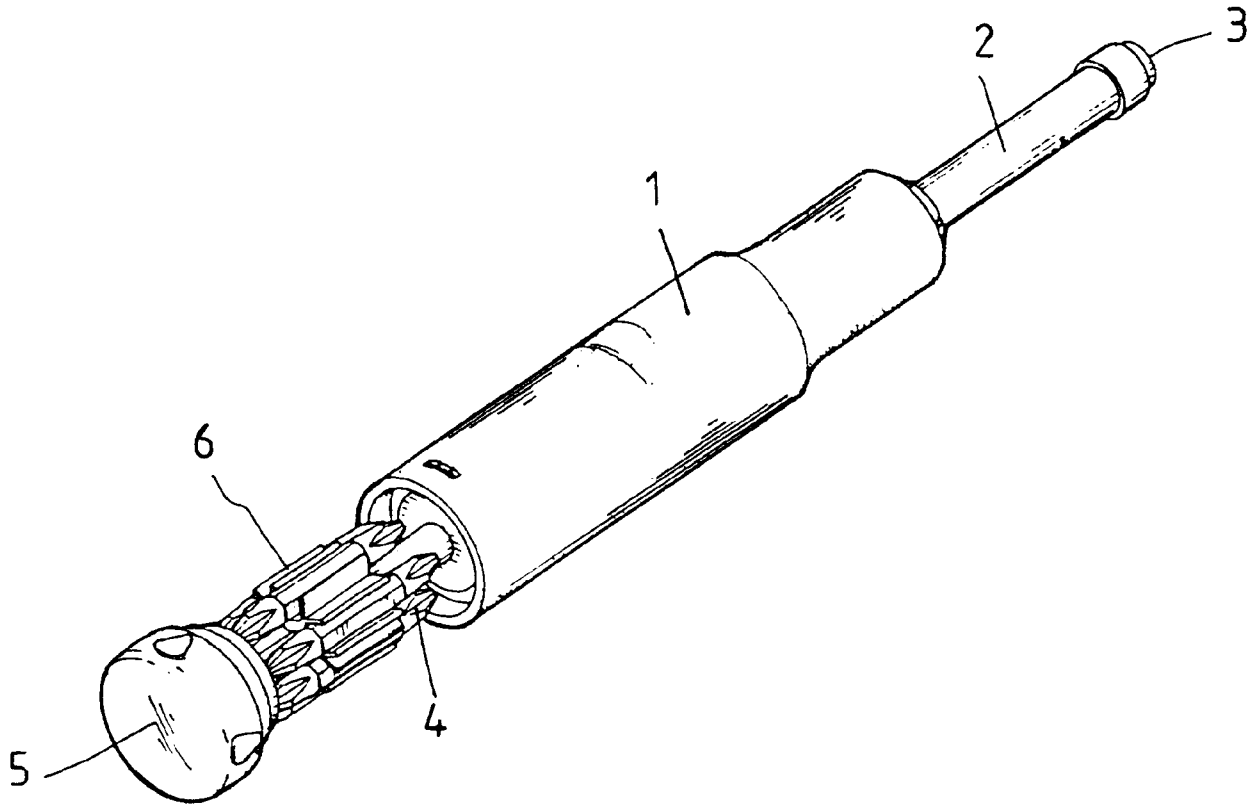
FIG. 1 PRIOR ART
FIG. 1 shows a conventional screwdriver.
Figure 2:
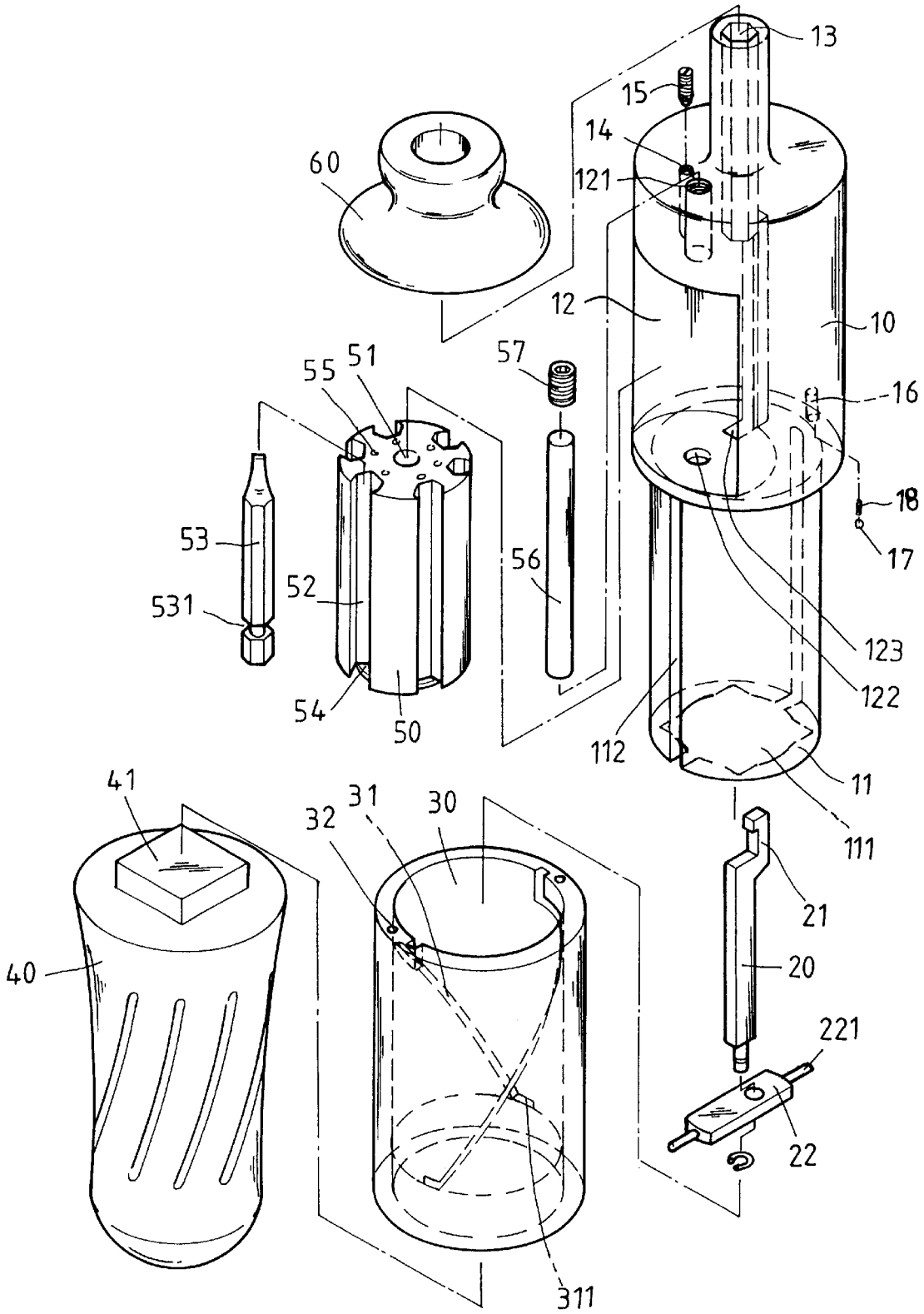
FIG. 2 is an exploded perspective view of the present invention showing all parts.
Figure 3:
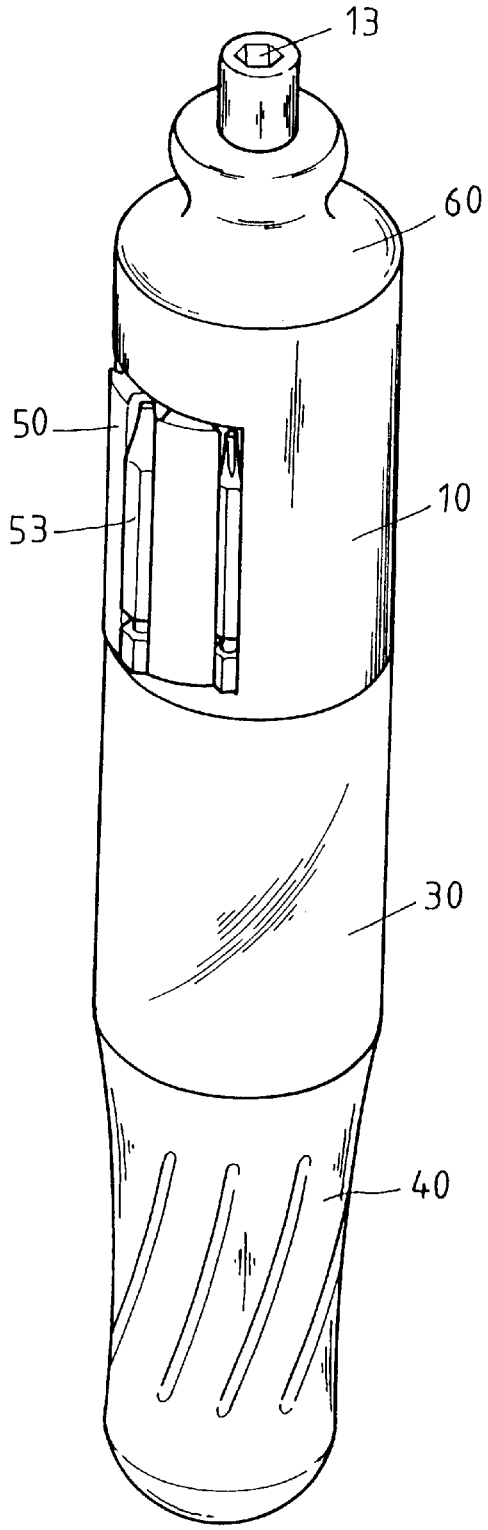
FIG. 3 is a perspective view of the present invention.
Figure 4:
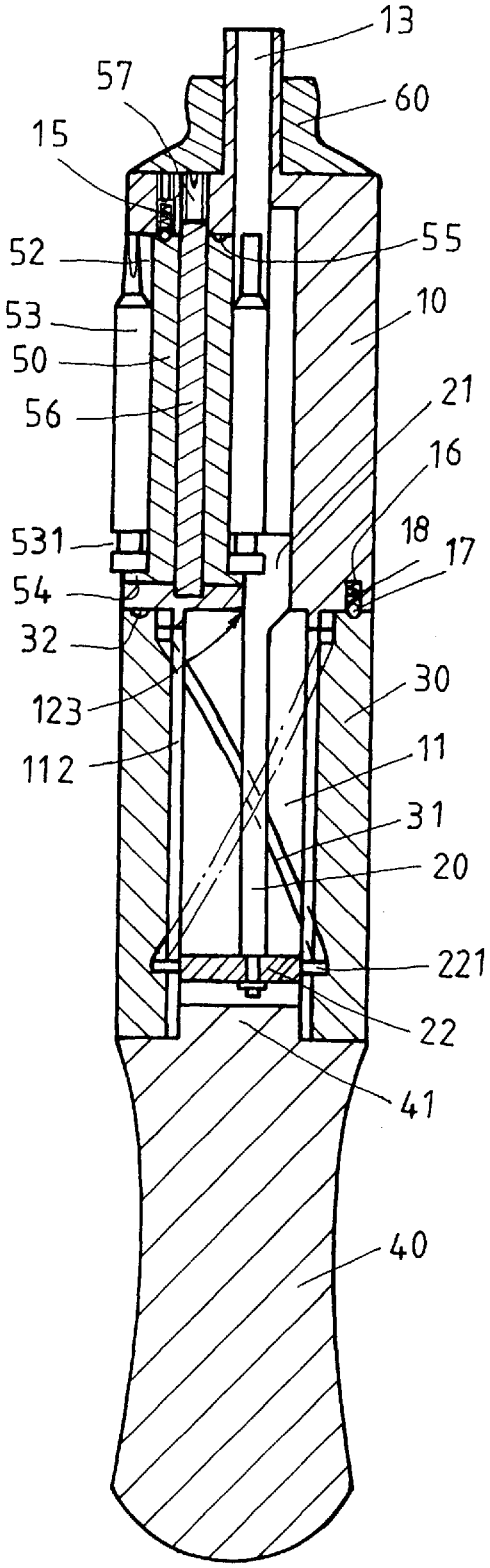
FIG. 4 is a cross-sectional view of the present invention.

Referring to FIGS. 2 to 4, the present invention "A screwdriver with easily replaceable bit" comprises:

A body 10: This body 10 includes an extended straight tube portion 11 and a storage portion 12. A square recess 111 is disposed on a bottom end of the straight tube portion 11. A pair of straight slots 112 are disposed in the straight tube portion 11. The storage portion 12 has an opening on one side of the body 10. An upper screw hole 121 and a lower screw hole 122 are disposed on the top end and bottom end of the storage portion 12 respectively. A bit hole 13 is disposed on a top end of the body 10. A channel 123 beside the lower screw hole 122 is disposed on a bottom end of the storage portion 12 corresponding to the bit hole 13. The body 10 has a screw hole 14 for a positioning element 15 with a positioning steel ball to be secured therein. And, a cavity 16 is disposed on bottom surface of the body 10 so that a spring 18 and a steel ball 17 can be stored in this cavity 16.

A sliding element 20: It is disposed in the straight tube portion 11 of the body 10. A hook 21 extends from a top end of the sliding element 30 and protrudes into the storage portion 11. It has a guiding block 22 with two protrusions 221 respectively protruding into the straight slots 112. The guiding block 22 is disposed on the bottom end of the sliding element 20. And, the hook 21 can protrude into the space of the storage portion 12.

A controlling element 30: It is disposed on the straight tube portion 11 of the body 10. A plurality of curved guiding slots 31 are disposed on an inner surface of the controlling element 30 for guiding the protrusions 221. A pair of laterally limiting slots 311 protruding into the straight slots 112 are disposed near a bottom end of the controlling element 30. A pair of locking recesses 32 are disposed on a top end of the controlling element 30. In this manner, the guiding slots 31 can allow the protrusions 221 of the sliding element 20 to insert therein. The controlling element 30 fits on the straight tube portion 11 of the body 10. Furthermore, the function provided by the locking recesses 32 is to engage with the steel ball 17 of the body 10.

A handle 40: It is secured on a bottom end of the straight tube portion 11 of the body 10. A square protrusion 41 is disposed on the top end of the handle 40 so as to fit with the square recess 111 on the bottom end of the straight tube portion 11.

A rotatable bit case 50: It has an axially-extending hole 51 and a plurality of longitudinal slots 52 around the axially-extending hole 51 for inserting bits 53. Each bit 53 has a circular recess 531 near the rear end of its bit. A suitable portion of the bit 53 is protruded over the longitudinal slots 52. It has a stopping surface 54 having a diameter approximately larger than an inner periphery of the longitudinal slots 52 for holding these bits 53. And, several locking holes 55 are disposed on a top end of the bit case 50. A shaft 56 of the bit case 50 pivotally inserts into the axially-extending hole 51 and the screw hole 121 of the body 10. As a result of this shaft 56, the bit case 50 is positioned in the storage portion 12. And, a bit 53 will be aligned with the bit hole 13. A latch 57 is screwed in the screw hole 121 for sealing the shaft 56. Because the diameter of the bit case 50 is smaller than the distance between the shaft 56 to the hook 21 of sliding element 20, the hook 21 of the sliding element 20 will engage with the circular recess 531 of the bit 53.

An outer cover 60: It is secured on the top end of the body 10.

Figure 5:
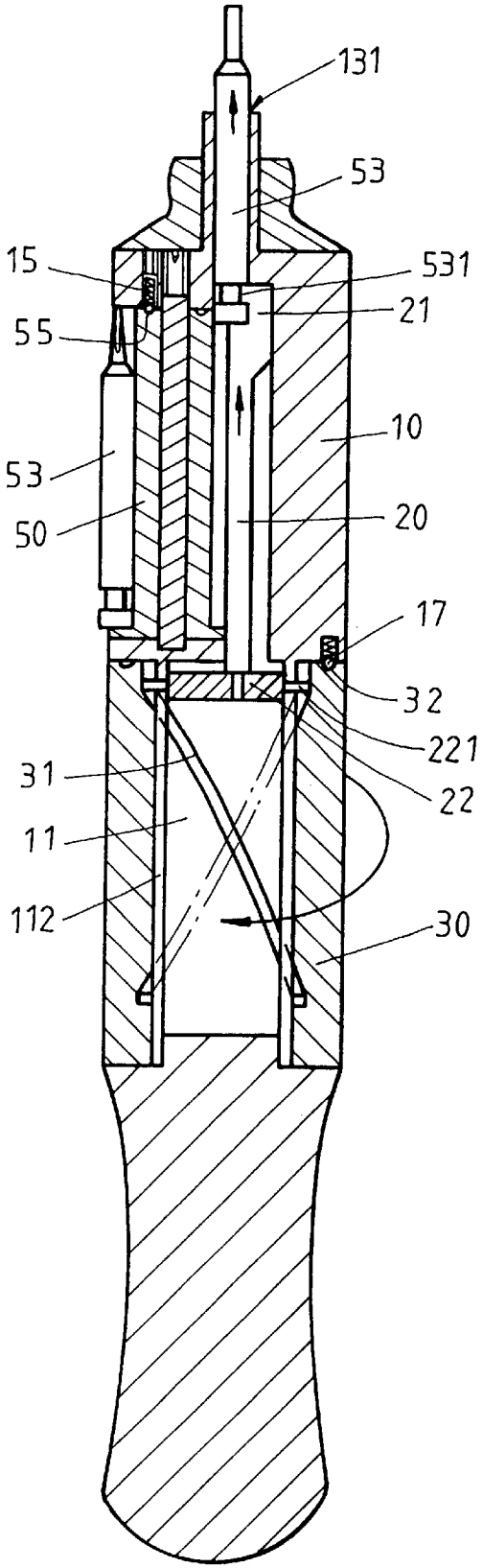
FIG. 5 shows the push-up condition of the present invention.
Figure 6:
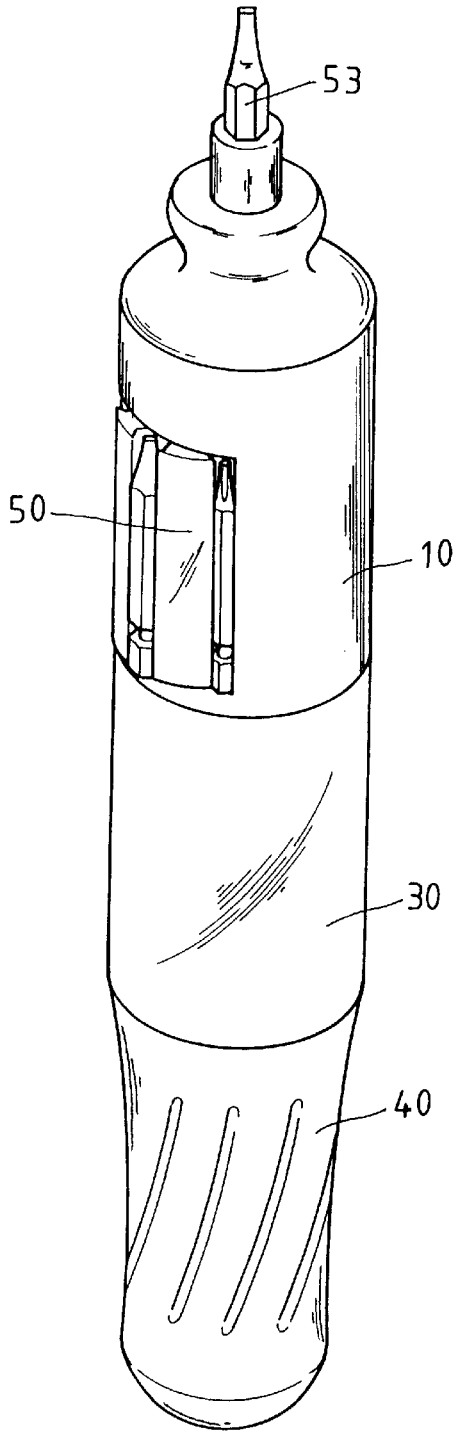
FIG. 6 is a perspective view of the present invention during use.
Figure 7:
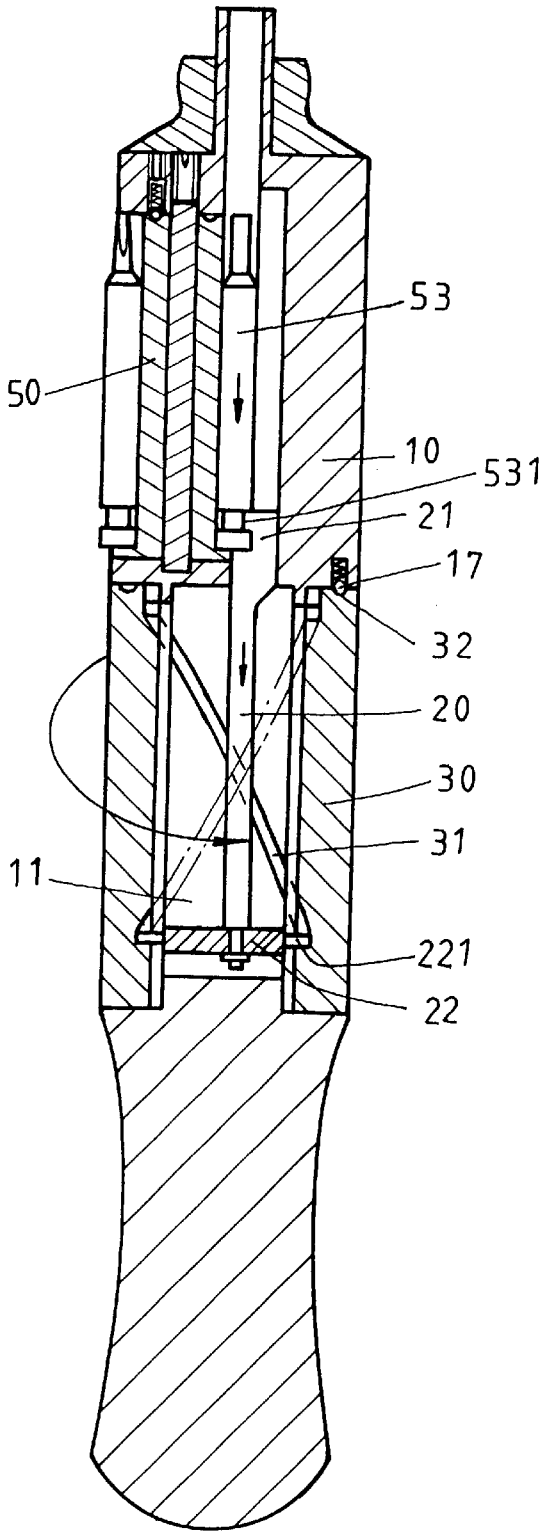
FIG. 7 shows the pull-back condition of the present invention.
Figure 8:
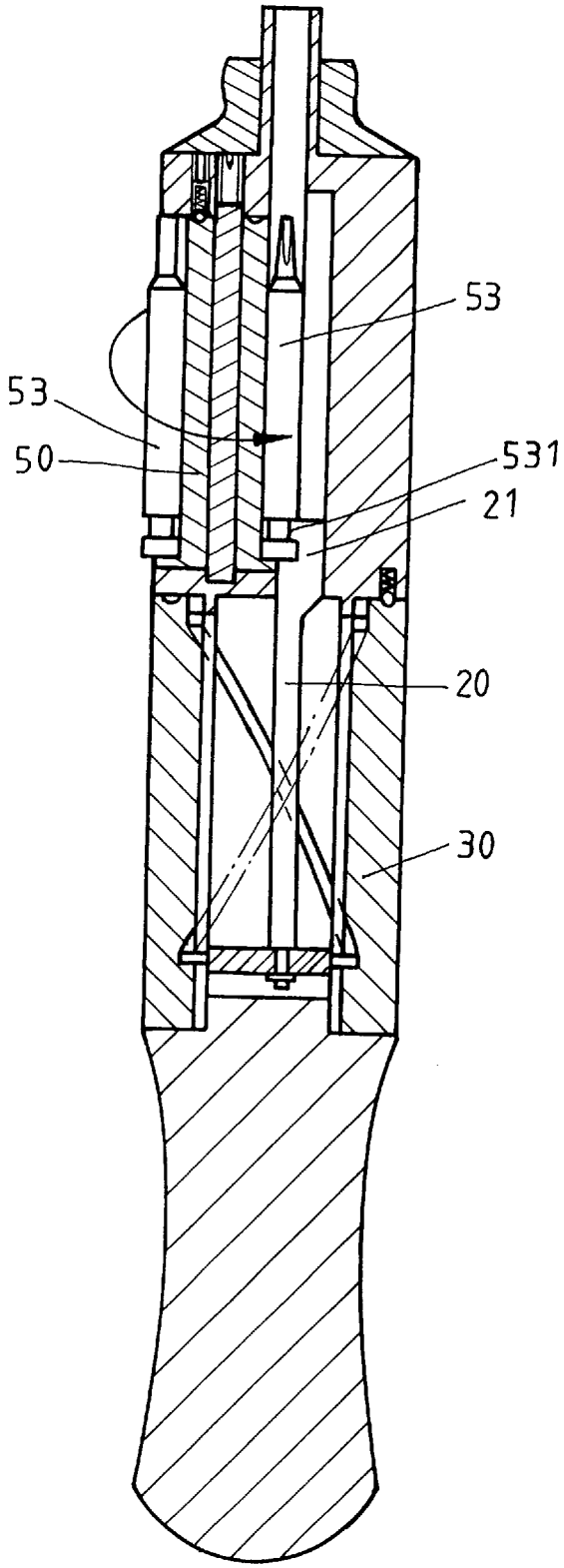
FIG. 8 shows the replacement of the bit of the present invention.
Figure 9:
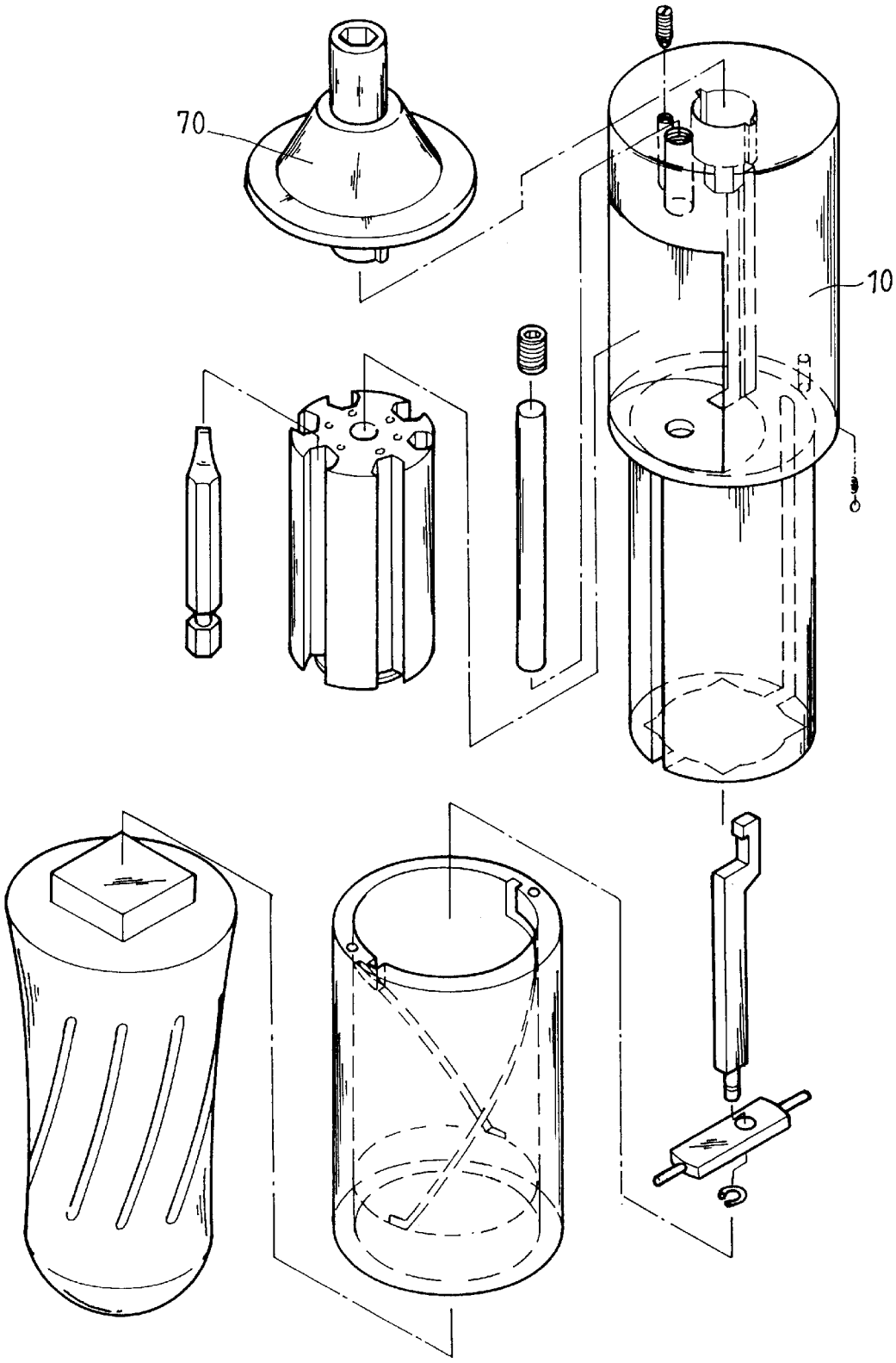
FIG. 9 is an exploded perspective view of the present invention combining with a ratchet head.

As shown in FIGS. 5 and 6, when the user wants to use the screwdriver of the present invention, the user just rotates the bit case 50 to select a desired bit 53. By using a positioning element 15 of the body 10 that protrudes into the locking hole 55, the bit 53 will be aligned with the bit hole 13. So, the hook 21 of the sliding element 20 will engage with the circular recess 531. After that, the controlling element 30 can be rotated. By means of the guiding slots 31, the protrusions 221 of the sliding element 20 are moved along the guiding slots 31 and then straightly moved along the straight slots 112. Also, a surface of the hook 21 of the sliding element 20 will push up the bit 53 to move forward. Finally, the locking recess 32 is allowed to engage with the steel ball 17 of the body 10. At this moment, the bit 53 protrudes over the bit hole 13 of the body 10. This completes the procedure of assembling the screwdriver of the present invention for immediate use In addition, referring to FIGS. 2 and 7, when the user wants to replace the bit 53, this user can rotate the controlling element 30 back. Thus, the protrusions 221 of the sliding element 20 are moved back along the guiding slots 31. At this time, the hook 21 of the sliding element 20 will pull the bit 53 back. When the steel ball 17 moves to the position of the other locking recess 32, it will be engaged again. Also, it makes the protrusions 221 of the sliding element 20 to slide into the limiting slots 311 and makes the bit 53 back to its original position inside the bit case 50. Thus, the bit 53 is moved back automatically. Therefore, the user can rotate the bit case 50 to select another desired bit 53 again. And, the hook 21 of the sliding element 20 can engage on the newly selected bit 53 to automatically push out or draw back. This bit replacement procedure is very easy and convenient. Of course, it improves the ease of use and the utility of the screwdriver significantly. Please see FIG. 9. It illustrates the present invention combining with an additional ratchet head 70. Thus, the ratchet head 70 can be installed in the bit hole 13 of the body 10 to increase the efficiency while using this screwdriver.

Therefore, when the user wants to replace a bit of the screwdriver, this person only needs to rotate the bit case and cooperate with the controlling element such that the bit can be pushed out or pulled back automatically. Thus, the function of easily exchanging the bit is achieved.

The above embodiments are only used to illustrate the present invention, not intended to limit the scope thereof. Many modifications of the above embodiments can be made without departing from the spirit of the present invention.

What is claimed is:

1. A screwdriver with easily replaceable bits comprising:

a body including a storage portion and a straight tube portion, a bit hole being disposed on a top end of said body, said storage portion having an opening on one side of the body, a pair of straight slots being disposed in said straight tube portion;

a sliding element being disposed in said straight tube portion of the body, a hook extending from a top end of said sliding element and protruding into said storage portion, a pair of protrusions being laterally extending from a bottom end of said sliding element;

a controlling element being disposed on said straight tube portion of said body, a plurality, of guiding slots being disposed on an inner surface of the controlling element for guiding said protrusions;

a handle secured on a bottom of said straight tube portion of said body; and a rotatable bit case having several longitudinal slots for inserting bits, each bit having a circular recess, said bit case being pivoted in said storage portion so that the hook of said sliding element can engage with the circular recess of said bit.

2. The screwdriver with easily replaceable bits as claimed in claim 1, wherein a pair of locking recesses are disposed on a top end of said controlling element, and a pair of laterally limiting slots are disposed near a bottom end of said controlling element.

3. The screwdriver with easily replaceable bits as claimed in claim 2, wherein a channel is disposed on a bottom end of said storage portion corresponding to said bit hole, a cavity is disposed on a top end of said straight tube portion corresponding to said locking recess of the controlling element so that a spring and a steel ball can be stored in said cavity, and a square recess is disposed on a bottom end of said straight tube portion for inserting a square protrusion of said handle.

4. The screwdriver with easily replaceable bits as claimed in claim 1, wherein a plurality of locking holes are disposed on a top end of said bit case, said body has a screw hole facing one of said locking holes, a positioning element with a positioning steel ball is secured in said screw hole and said positioning steel ball can lock into one of said locking holes of said bit case, and a stopping surface is disposed on a bottom end of said bit case, said stopping surface having a diameter approximately larger than an inner periphery of said longitudinal slots.

5. The screwdriver with easily replaceable bits as claimed in claim 1, wherein said two protrusions are provided in a guiding block, which is disposed on said end of the sliding element.

6. The screwdriver with easily replaceable bits as claimed in claim 1, wherein an outer cover is secured on the top end of the body.

7. The screwdriver with easily replaceable bits as claimed in claim 1, wherein a ratchet head is disposed on said bit hole of said body.

* * * * *